US007163431B2

(12) United States Patent
Walraven

(10) Patent No.: US 7,163,431 B2
(45) Date of Patent: Jan. 16, 2007

(54) TOY PERCUSSION INSTRUMENT WITH TETHERED STRIKER

(75) Inventor: Thomas M. Walraven, Cuyahoga Falls, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 10/757,175

(22) Filed: Jan. 14, 2004

(65) Prior Publication Data

US 2005/0153626 A1 Jul. 14, 2005

(51) Int. Cl.
*A63H 5/00* (2006.01)
*G10D 13/02* (2006.01)

(52) U.S. Cl. ..... 446/408; 446/418; 84/413

(58) Field of Classification Search ..... 446/397, 446/404, 318, 71, 76, 227, 421, 418, 408; 84/422.4, 422.1, DIG. 12, 412, 413, 420
See application file for complete search history.

(56) References Cited

U.S. PATENT DOCUMENTS 546,021 A * 9/1895 Luckenbach ..... 446/298
1,109,903 A * 9/1914 Cruver et al. ..... 84/420
1,914,652 A * 6/1933 Stoer ..... 84/420
2,620,703 A * 12/1952 Lebensfeld et al. ..... 84/420
2,655,071 A * 10/1953 Levay ..... 84/422.1
4,909,117 A * 3/1990 Reiling et al. ..... 84/738
4,939,972 A * 7/1990 Falberg ..... 84/422.4
5,607,091 A * 3/1997 Musacchia ..... 224/222
5,716,254 A * 2/1998 Bowes ..... 446/397
6,328,626 B1 * 12/2001 Eubanks ..... 446/397
6,443,803 B1 * 9/2002 Epple, Jr. ..... 446/418
D489,398 S * 5/2004 Pollock ..... D17/22

* cited by examiner

*Primary Examiner*—Faye Francis
(74) *Attorney, Agent, or Firm*—Renner, Otto, Boisselle & Sklar, mLLP

(57) ABSTRACT

A toy percussion instrument that is characterized by a novel method of attaching a tether to a striker and/or main instrument body. The new location of attachment enables compliance with stringent safety standards without detracting from the playability of the toy instrument. In particular, two tethered strikers can be provided while still satisfying cord maximum perimeter standards and at the same time allowing an appropriate length of cord to play the instrument without difficulty. The provision of two tethered strikers enables a more realistic instrument while satisfying a parent's preference to have the tethers. In particular, The striker attachment location is spaced inwardly from the ends of the striker, thereby to allow a shorter tether to be used while still allowing the instrument to be played without difficulty.

26 Claims, 1 Drawing Sheet

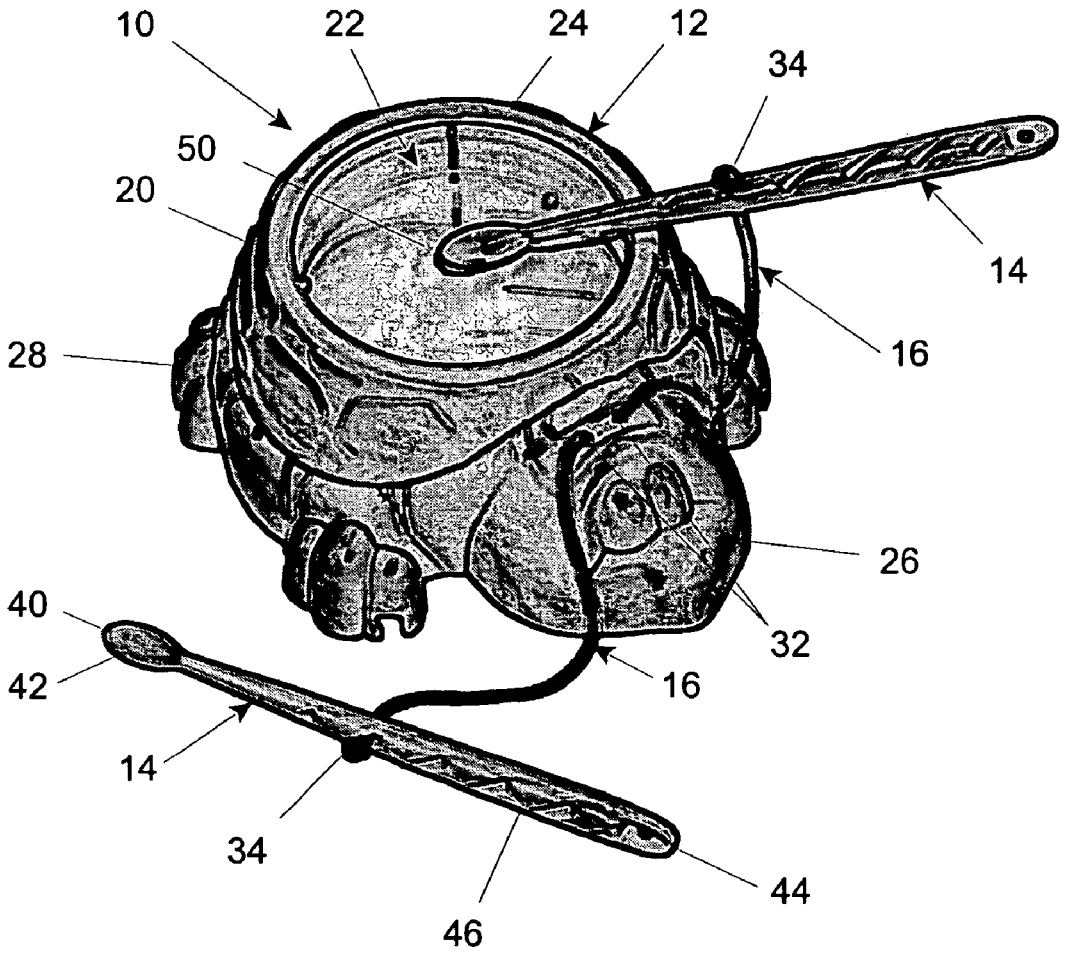
10
22
24
12
34
50
20
14
16
28
26
40
32
42
16
14
34
44
46

TOY PERCUSSION INSTRUMENT WITH TETHERED STRIKER

The invention herein described relates generally to toy percussion instruments designed for young children and, more particularly, to such instruments with one or more tethered strikers used to play the instrument. The invention also has more general applicability to toys comprising a main unit and one or more implements that are tethered to the main unit.

BACKGROUND OF THE INVENTION

In the past, toy manufacturers have used a tethered striker for musical percussion instruments, as is desired particularly by parents to prevent the strikers from becoming separated from the instrument and/or lost. For example, the Little RhythmMaker™ Drum sold by Little Tikes is a child-sized drum that comes with two tethered drumsticks. One end of each tether is attached to a respective opposite side of the drum and the other end is attached to an end of the respective drumstick. The Little RhythmMaker™ Drum is intended for children of two years of age and up.

Instruments intended for younger children typically have only a single tethered striker. Toy safety standards make it difficult to incorporate more than one tethered striker. If the tethers can tangle or form a loop, or both, in connection with any part of the toy, the perimeter of the loop should be less than 14 inches for children younger than 18 months. Thus, if a second tethered striker is employed, the tethers had to be of length that made it difficult for a young child to use the strikers, thereby reducing the play value of the toy instrument. On the other hand, the provision of only single striker oftentimes made the toy less realistic, as in the case of a drum which is normally played with two drumsticks.

SUMMARY OF THE INVENTION

The present invention provides a toy percussion instrument that is characterized by a novel method of attaching a tether to a striker and/or main instrument body. The new location of attachment enhances playability without detracting from the safety characteristics of the toy instrument. In particular, two tethered strikers can be provided while still satisfying cord maximum perimeter standards and at the same time allowing an appropriate length of cord to play the instrument without difficulty. The provision of two tethered strikers enables a more realistic instrument while satisfying a parent's preference to have the tethers.

According to one aspect of the inventions, a toy percussion instrument comprises an instrument body; at least one striker for striking the instrument body to produce a sound; and a tether connecting each striker to the instrument body. The tether has one end connected to the instrument body at a respective body attachment location, and an opposite end connected to the striker at a striker attachment location. The striker attachment location is spaced inwardly from the ends of the striker, thereby to allow a shorter tether to be used while still allowing the instrument to be played without difficulty.

Preferred embodiments of the toy percussion instrument are characterized by one or more of the following features:

(a) the striker attachment location being spaced inwardly from the ends of the striker by at least one fifth the length of the striker, more preferably by one fourth the length of the striker, and still more preferably by one third the length of the striker;

(b) the striker has a rounded striker end portion and an opposite handle end portion;

(c) two said strikers and tethers are provided, and the respective body attachment locations are located on the same side of the instrument body;

(d) the instrument body has a drumming surface surrounded by a peripheral wall, and the striker attachment location on each striker is spaced inwardly from the striker end of the striker by a distance about equal the distance between the respective body attachment location and the center of the drumming surface;

(e) the body attachment location of each tether is located on the peripheral wall at the same or about the same location;

(f) the instrument body has the shape of an animal;

(g) the animal shape is that of a turtle and the drumming surface forms at least a part of the turtle's shell;

(h) the combined length of the tethers and any spacing between the body attachment locations is no greater than about 14 inches; and (i) the instrument body is in the form of at least one of an animal, a drum and a xylophone.

As will be appreciated, principles of the invention have more general applicability to toys that comprise a main unit and one or more tethered accessory implements that are intended to be used with the main unit. Accordingly, a toy comprises a main unit; at least one implement for use with the main unit; and a tether connecting each implement to the main unit. The tether has one end connected to the main unit at a respective main unit attachment location, and an opposite end connected to the implement at an implement attachment location. The implement attachment location is spaced inwardly from the ends of the implement, thereby to allow a shorter tether to be used while still allowing the implement to be used without difficulty.

The foregoing and other features of the invention are hereinafter fully described and particularly pointed out in the claims, the following description and annexed drawing setting forth in detail a certain illustrative embodiment of the invention, this embodiment being indicative, however, of but one of the various ways in which the principles of the invention may be employed.

BRIEF DESCRIPTION OF THE DRAWING

The sole FIGURE of the drawing is a perspective view of a toy percussion instrument according to a preferred embodiment of the invention.

DETAILED DESCRIPTION

Referring now in detail to the drawing, a toy percussion instrument according to the invention is indicated generally at 10. The toy percussion instrument 10 generally comprises an instrument body 12, at least one striker 14 for striking the instrument body to produce a sound, and a tether 16 connecting the striker to the instrument body. The tether prevents the striker from being separated from the instrument body as is often desired by parents. To provide a more realistic instrument, oftentimes it will be desirable to provide two tethered strikers as shown, and even more tethered strikers could be provided if desired.

The instrument body 12 can assume any of a variety of forms including that of an animal, drum, xylophone, etc. In the illustrated embodiment, the instrument body has the shape of an animal and, in particular, a turtle. A portion of the instrument body forms the shell 20 of the turtle and the shell in part is formed by a drumming surface 22 that preferably is circular in shape. The drumming surface is surrounded by a peripheral wall 24 from which the balance of the instrument body can be formed, including the remainder of the turtle's shell 20 and other parts of the turtle including the head 26 and feet 28. The instrument body can be formed from any suitable material, such as plastic that can be molded to a desired shape by well known molding techniques. The drumming surface 22 can be formed integrally with the balance of the body or formed separately, for example by a separate drumhead. The reference herein made to a "drumming" surface is not intended to be limited to just a drumhead, but instead is intended to encompass any surface of the instrument body intended or designed to be struck by the striker to produce a musical sound, such as a drumhead, symbol, or a bar or bars of a xylophone.

The tether or tethers 16 can be formed from any suitable material, and can be inelastic or elastic as desired. For example, the tethers can be cords (as shown), ribbons or other types of flexible elongate attachment means. Each tether has one end connected by any suitable attachment means to the instrument body 12 at a respective body attachment location 32, and an opposite end connected by any suitable means to the striker 14 at a striker attachment location 34.

Each striker 14 can be of any suitable form and material, and typically will have the appearance of the striker of the instrument the toy instrument is intended to mimic. Thus, for example, each striker can have the appearance of a drumstick for use with a drum-like toy instrument or the appearance of a mallet for use with a xylophone-like instrument. Typically, each striker will have at one end 40 a rounded striker portion 42 and at its opposite end 44 a handle portion 46 that can be easily gripped by the child playing the toy instrument.

In accordance with the invention, the striker attachment location 34 is spaced inwardly from the ends 40 and 44 of the striker 14, thereby to allow a shorter tether to be used while still allowing the instrument to be played without difficulty. More particularly, the striker attachment location is spaced inwardly from the ends of the striker by at least one fifth the length of the striker, more preferably by one fourth the length of the striker, and still more preferably by one third the length of the striker. The striker attachment location 34 on each striker can be spaced inwardly from the striker end 40 of the striker 14 by a distance about equal the distance between the respective body attachment location 32 and the center 50 of the drumming surface 22. This enables the length of the cord to be less than that needed if the cord were attached to the end of the striker as was done in the past, while still allowing play of the instrument without difficulty. In the case of non-circular drumming surfaces, such as row of bars of a xylophone, the center of the drumming surface would be viewed as the center of the row of bars to be struck by the striker.

Consequently, the new location of attachment of the tether to the striker enables compliance with stringent safety standards without detracting from the playability of the toy instrument. In particular, two tethered strikers can be provided while still satisfying cord maximum perimeter standards and at the same time allowing an appropriate length of cord to play the instrument without difficulty. According to one such standard for tethers that can tangle or form a loop, or both, in connection with any part of the toy, the perimeter of the loop should be less than 14 inches for children younger than 18 months. Accordingly, the combined length of the tethers 16 and any spacing between the body attachment locations 32 preferably is no greater than about 14 inches. i.e. the sum of the lengths of the tethers and the length of the spacing (if any) between the attachment locations is no greater than about 14 inches. If the tethers are elastic (stretchable), this criteria should be met with the tethers are stretched upon application of a prescribed amount of force. According to another recommended standard for toys intended for children younger than 18 months, each tether individually should be less than 12 inches long.

As will be appreciated, longer length tethers generally can be used if the body attachment points are located at the same or about the same location at one side of the drumming surface. Preferably, for an instrument like that shown, the body attachment points should be spaced apart no greater than 2 inches, more preferably no greater than 1 inch, and more preferably no greater than one half inch. The spacing, however, may vary depending on the overall configuration of the toy instrument.

As above mentioned, principles of the invention have more general applicability to toys that comprise a main unit and one or more tethered implements that are intended to be used with the main unit. In this regard, the instrument body is but one example of a main unit, and the striker is but one example of an implement that can be used by the child when playing with the main unit. Thus, the tether connects each implement to the main unit, thereby to prevent the implement or implements from becoming separated from the main unit. The tether has one end connected to the main unit at a respective main unit attachment location, and an opposite end connected to the implement at an implement attachment location. The implement attachment location is spaced inwardly from the ends of the implement, thereby to allow a shorter tether to be used while still allowing the implement to be used without difficulty. As is preferred, the implement attachment location is spaced inwardly from a non-handle end of the implement by a distance about equal the distance between the main unit attachment location and a center of a play area of the main unit.

By way of further example, the main unit can be in the form of a toy workbench, and the implements can be tools (hammer, screwdriver, etc.) that are tethered to the workbench as above described, with the center of the task surface of the workbench forming the play area. Yet another example is a toy kitchen unit to which one or more kitchen utensils (pan, teapot, spoon, etc.) are tethered, with the center of the kitchen counter forming the center of the play area. Still another example is a toy engine to which one or more tools (wrench, screwdriver, etc.) are tethered. These are just a few of the types of main units and implements to which the principles of the invention can be applied.

Although the invention has been shown and described with respect to certain illustrated embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiments of the invention. In addition, while a particular feature of the invention may have been described above with respect to only one of several illustrated embodiments, such a feature may be combined with one or more other features of the other embodiment, as maybe desired and advantageous for any given or particular application.

What is claimed is:

1. A toy percussion instrument, comprising:

an instrument body;

two strikers for striking the instrument body to produce a sound; and two tethers respectively connecting the strikers to the instrument body;

wherein each tether has one end connected to the instrument body at a body attachment location, and an opposite end connected to the respective striker at a striker attachment location, the striker attachment location being spaced inwardly from the ends of the respective striker by at least one fourth the length of the striker;

wherein each striker has a rounded striker end portion and an opposite handle end portion; and wherein the body attachment locations are located on the same side of the instrument body.

2. A toy percussion instrument as set forth in claim 1, wherein the striker attachment location is spaced inwardly from the ends of the striker by at least one fourth the length of the striker.

3. A toy percussion instrument as set forth in claim 2, wherein the striker has a rounded striker end portion and an opposite handle end portion.

4. A toy percussion instrument as set forth in claim 1, wherein the instrument body has a drumming surface surrounded by a peripheral wall, and the striker attachment location is spaced inwardly from the outer end of striker end portion of the respective striker by a distance about equal the distance between the respective body attachment location and the center of the drumming surface.

5. A toy percussion instrument as set forth in claim 4, wherein the body attachment locations are located on the peripheral wall at the same or about the same location.

6. A toy percussion instrument as set forth in claim 5, wherein the instrument body has the shape of an animal.

7. A toy percussion instrument as set forth in claim 6, wherein the animal shape is that of a turtle and the drumming surface forms at least a part of the turtle's shell.

8. A toy percussion instrument as set forth in claim 7, wherein the combined length of the tethers and any spacing between the body attachment locations is no greater than about 14 inches.

9. A toy percussion instrument as set forth in claim 8, wherein the instrument body has the shape of an animal.

10. A toy percussion instrument, comprising:

an instrument body having a drumming surface;

two strikers for striking the drumming surface to produce a sound; and two tethers respectively connecting the strikers to the instrument body;

wherein each tether has one end connected to the instrument body at a body attachment location adjacent the drumming surface, and an opposite end connected to the respective striker at a striker attachment location, the striker attachment location being spaced inwardly from an outer end of a striker end portion of the respective striker by a distance about equal the distance between the body attachment location and a center of the drumming surface; and wherein the combined length of the tethers and any spacing between the body attachment locations is no greater than about 14 inches.

11. A toy percussion instrument as set forth in claim 10, wherein each striker has a rounded striker end portion and an opposite handle end portion.

12. A toy percussion instrument as set forth in claim 10, wherein the body attachment locations are located on the same side of the instrument body.

13. A toy percussion instrument as set forth in claim 9, wherein the animal shape is that of a turtle and the drumming surface forms at least a part of the turtle's shell.

14. A toy percussion instrument, comprising:

an instrument body having a drumming surface;

two strikers for striking the drumming surface to produce a sound; and two tethers respectively connecting the strikers to the instrument body;

wherein each tether has one end connected to the instrument body at a body attachment location adjacent the drumming surface, and an opposite end connected to the respective striker at a striker attachment location, the striker attachment location being spaced inwardly from the outer end of striker end portion of the respective striker by a distance about equal the distance between the body attachment location and a center of the drumming surface; and wherein the body attachment locations are located at the same or about the same location.

15. A toy percussion instrument as set forth in claim 14, wherein each striker has a rounded striker end portion and an opposite handle end portion.

16. A toy percussion instrument, comprising:

an instrument body having a drumming surface;

two strikers for striking the drumming surface to produce a sound; and two tethers respectively connecting the strikers to the instrument body;

wherein each tether has one end connected to the instrument body at a body attachment location adjacent the drumming surface, and an opposite end connected to the respective striker at a striker attachment location, the striker attachment location being spaced inwardly from the outer end of striker end portion of the respective striker by a distance about equal the distance between the body attachment location and a center of the drumming surface;

wherein each striker has a rounded striker end portion and an opposite handle end portion; and wherein the body attachment locations are located at the same or about the same location.

17. A toy percussion instrument as set forth in claim 16, wherein the instrument body is in the form of at least one of an animal and a drum.

18. A toy, comprising:

a main unit having a play area with a center;

two implements manipulable by a child in relation to the play area of the main unit, each implement having a handle end portion and a non-handle end portion; and two tethers respectively connecting the implements to the main unit;

wherein each tether has one end connected to the implement at a main unit attachment location, an opposite end connected to the implement at an implement attachment location, and an intermediate portion extending loosely between the ends of the tether, the implement attachment location being fixed in relation to and spaced inwardly from a non-handle end of the implement by a distance about equal the distance between the main unit attachment location and the center of the play area, and the combined length of the tethers and any spacing between the main unit attachment locations is no greater than 14 inches.

19. A toy as set forth in claim 18, wherein the striker attachment location is spaced inwardly from an outer end of non-handle end portion of the respective striker by a distance about equal the distance between the respective main unit attachment location and the center of the play area.

20. A toy percussion instrument as set forth in claim 19, wherein the play area is surrounded by a peripheral wall, and the main unit attachment locations are located on the peripheral wall at the same or about the same location.

21. A toy percussion instrument as set forth in claim 20, wherein the main unit has the shape of an animal.

22. A toy percussion instrument, comprising:

an instrument body having a drumming surface;

two strikers for striking the drumming surface to produce a sound; and two tethers respectively connecting the strikers to the instrument body;

wherein each tether has one end connected to the instrument body at a body attachment location adjacent the drumming surface, and an opposite end connected to the respective striker at a striker attachment location, the striker attachment location being spaced inwardly from the outer end of striker end portion of the respective striker by a distance about equal the distance between the body attachment location and a center of the drumming surface; and wherein the body attachment locations are located at the same or about the same location.

23. A toy comprising:

a main unit having a play area with a center;

two implements manipulable by a child in relation to the play area of the main unit, each implement having a handle end portion and a non-handle end portion; and two tethers respectively connecting the implements to the main unit;

wherein each tether has one end connected to the main unit at a main unit attachment location, an opposite end connected to the respective implement at an implement attachment location from which the tether extends away from the respective implement, and an intermediate portion extending loosely between the ends of the implement, the implement attachment location being located between the handle end portion and non-handle end portion of the respective implement; and wherein the respective main unit attachment locations are located on the same side of the main unit, and the combined length of the tethers and any spacing between the body attachment locations is no greater than 14 inches.

24. A toy as set forth in claim 23, wherein the striker attachment location is spaced inwardly from an outer end of non-handle end portion of the respective striker by a distance about equal the distance between the respective main unit attachment location and the center of the play area.

25. A toy percussion instrument as set forth in claim 24, wherein the play area is surrounded by a peripheral wall, and the main unit attachment locations are located on the peripheral wall at the same or about the same location.

26. A toy percussion instrument as set forth in claim 25, wherein the main unit has the shape of an animal.

* * * * *